US009483001B1

(12) United States Patent
Yokoyama et al.

(10) Patent No.: US 9,483,001 B1
(45) Date of Patent: Nov. 1, 2016

(54) FIXING DEVICE AND IMAGE FORMING APPARATUS

(71) Applicant: FUJI XEROX CO., LTD., Tokyo (JP)

(72) Inventors: Yuki Yokoyama, Kanagawa (JP); Mitsuhiro Matsumoto, Kanagawa (JP); Keitaro Mori, Kanagawa (JP); Masayo Higashimura, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 15/016,695

(22) Filed: Feb. 5, 2016

(30) Foreign Application Priority Data

Aug. 26, 2015 (JP) ..... 2015-166347

(51) Int. Cl.
*G03G 15/20* (2006.01)

(52) U.S. Cl.
CPC ..... *G03G 15/2075* (2013.01); *G03G 15/206* (2013.01); *G03G 15/2057* (2013.01); *G03G 2215/2048* (2013.01)

(58) Field of Classification Search
CPC ..... G03G 15/2025; G03G 15/2075; G03G 15/2017; G03G 15/2053; G03G 15/2057; G03G 15/206; G03G 2215/2048
See application file for complete search history.

(56) References Cited

U.S. PATENT DOCUMENTS 5,642,550 A * 7/1997 Maruyama ..... B08B 1/02 15/102
5,753,400 A * 5/1998 Kuramoto ..... B41M 7/0009 430/111.4
8,081,903 B2 12/2011 Hasegawa
2007/0212093 A1* 9/2007 Maeda ..... G03G 15/2039 399/69
2009/0123203 A1* 5/2009 Tanaka ..... G03G 15/2057 399/330
2010/0247174 A1 9/2010 Hori et al.

FOREIGN PATENT DOCUMENTS

JP 2009-086463 A 4/2009
JP 2010-078659 A 4/2010
JP 2010-231112 A 10/2010

* cited by examiner

*Primary Examiner* — David Gray
*Assistant Examiner* — Laura Roth
(74) *Attorney, Agent, or Firm* — Oliff PLC

(57) ABSTRACT

A fixing device includes a rotatable fixing member provided in a fixing area where an unfixed image on surface of a medium is fixed, the fixing member including at least a thermoplastic surface layer that softens at a temperature below a fixing temperature at which the image is fixed; and a cleaning member provided on a downstream side with respect to the fixing area in a direction of rotation of the fixing member and that cleans the fixing member while coming into contact with a hardened portion of the fixing member in a cleaning area, the cleaning area being at a temperature below the temperature at which the thermoplastic surface layer of the fixing member softens.

4 Claims, 4 Drawing Sheets

FIXING DEVICE AND IMAGE FORMING APPARATUS

CROSS-REFERENCE TO RELATED APPLICATIONS

This application is based on and claims priority under 35 USC 119 from Japanese Patent Application No. 2015-166347 filed Aug. 26, 2015.

BACKGROUND

1. Technical Field

The present invention relates to a fixing device and an image forming apparatus.

2. Summary

According to an aspect of the invention, there is provided a fixing device including a rotatable fixing member provided in a fixing area where an unfixed image on surface of a medium is fixed, the fixing member including at least a thermoplastic surface layer that softens at a temperature below a fixing temperature at which the image is fixed; and a cleaning member provided on a downstream side with respect to the fixing area in a direction of rotation of the fixing member and that cleans the fixing member while coming into contact with a hardened portion of the fixing member in a cleaning area, the cleaning area being at a temperature below the temperature at which the thermoplastic surface layer of the fixing member softens.

BRIEF DESCRIPTION OF THE DRAWINGS

An exemplary embodiment of the present invention will be described in detail based on the following figures, wherein.

DETAILED DESCRIPTION

Figure 1:
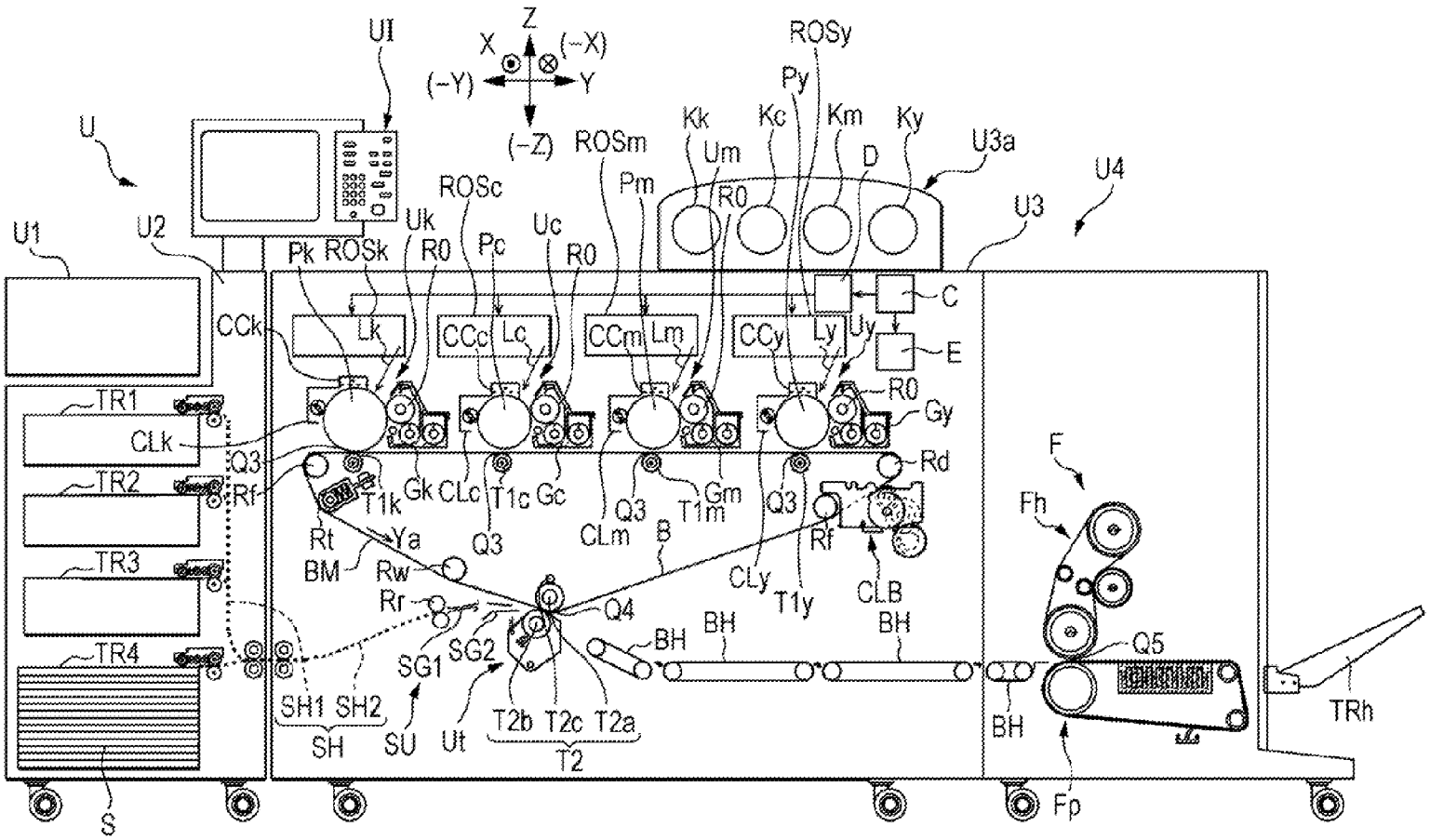
FIG. 1 illustrates the entirety of an image forming apparatus according to the exemplary embodiment of the present invention.

For easy understanding of the following description, directions in the drawings are defined as follows. The front-rear direction corresponds to the X-axis direction, the left-right direction corresponds to the Y-axis direction, and the top-bottom direction corresponds to the Z-axis direction. Furthermore, the sides indicated by arrows X, −X, Y, −Y, Z, and −Z correspond to the front side, the rear side, the right side, the left side, the upper side, and the lower side, respectively.

Furthermore, in the drawings, the circle with a dot corresponds to an arrow pointing in a direction from the back side of the page toward the front side of the page, and the circle with a cross corresponds to an arrow pointing in a direction from the front side of the page toward the back side of the page.

Note that irrelevant elements are not illustrated in the drawings for easy understanding of the following description.

FIG. 1 illustrates the entirety of an image forming apparatus U according to an exemplary embodiment of the present invention.

As illustrated in FIG. 1, the image forming apparatus U includes an operation unit UI, a scanner device U1 as an exemplary image reading section, a sheet feeding device U2, an image-forming-apparatus body U3, and a sheet discharge section U4.

The operation unit UI includes a power button, a copy start key, a key for setting the number of copies, and a numeric keypad as exemplary inputting portions. The operation unit UI further includes a display and other associated elements.

The scanner device U1 reads a document (not illustrated), converts information read from the document into image information, and outputs the image information to the image-forming-apparatus body U3.

The sheet feeding device U2 includes plural sheet trays TR1 to TR4 as exemplary sheet feeding units, and a sheet transport path SH1. Recording sheets S as exemplary media contained in the sheet trays TR1 to TR4 are picked up one by one, and each of the recording sheets S is transported along the sheet transport path SH1 to the image-forming-apparatus body U3.

As illustrated in FIG. 1, the image-forming-apparatus body U3 includes a controller C, a power circuit E, and so forth. The power circuit E is controlled by the controller C and supplies power to associated elements provided in the image-forming-apparatus body U3. The controller C receives the image information obtained through the reading of the document by the scanner device U1 or image information transmitted from a personal computer (not illustrated) as an exemplary information transmitting device that is connected to the image forming apparatus U.

The controller C processes the image information into pieces of printing information for yellow (Y), magenta (M), cyan (C), and black (K) and outputs the pieces of printing information to a laser driving circuit D as an exemplary circuit for driving latent-image-drawing devices. The laser driving circuit D outputs laser driving signals, which are inputted to the laser driving circuit D from the controller C, to latent-image-forming devices ROSy, ROSm, ROSc, and ROSk for the respective colors at a predetermined timing.

Image carrier units Uy, Um, Uc, and Uk for Y, M, C, and K are provided below the respective latent-image-forming devices ROSy, ROSm, ROSc, and ROSk.

Referring to FIG. 1, the image carrier unit Uk for black (K) includes a photoconductor drum Pk as an exemplary image carrier, a corotron CCk as an exemplary charger, and a photoconductor cleaner CLk as an exemplary image-carrier cleaner. The image carrier units Uy, Um, and Uc for the other colors of Y, M, and C also include respective photoconductor drums Py, Pm, and Pc; respective corotrons CCy, CCm, and CCc; and respective photoconductor cleaners CLy, CLm, and CLc.

In the present exemplary embodiment, the photoconductor drum Pk for black (K) that is used frequently and whose surface tends to wear fast has a larger diameter so as to achieve a higher speed of rotation and to have a longer life than the photoconductor drums Py, Pm, and Pc for the other colors.

The photoconductor drums Py, Pm, Pc, and Pk are charged uniformly by the respective corotrons CCy, CCm, CCc, and CCk. Subsequently, the latent-image-forming devices ROSy, ROSm, ROSc, and ROSk apply laser beams Ly, Lm, Lc, and Lk as exemplary latent-image-drawing beams to the surfaces of the respective photoconductor drums Py, Pm, Pc, and Pk. As a result, electrostatic latent images are formed on the surfaces of the respective photoconductor drums Py, Pm, Pc, and Pk. The electrostatic latent images on the surfaces of the photoconductor drums Py, Pm, Pc, and Pk are developed by developing rollers RO as exemplary developing members included in respective developing devices Gy, Gm, Gc, and Gk into toner images as exemplary visible images with developers having the respective colors of yellow (Y), magenta (M), cyan (C), and black (K).

The toner images on the surfaces of the photoconductor drums Py, Pm, Pc, and Pk are transferred to an intermediate transfer belt B as an exemplary intermediate transfer body and as an exemplary image carrier in first transfer areas Q3 by first transfer rollers T1*y*, T1*m*, T1*c*, and T1*k* as exemplary first transfer devices, respectively, in such a manner as to be superposed one on top of another. Thus, a multicolor image, i.e., a color image, is formed on the intermediate transfer belt B. The color image thus formed on the intermediate transfer belt B is transported to a second transfer area Q4.

If the image information contains only a piece of information on a black (K) image, only the photoconductor drum Pk and the developing device Gk for black are used, whereby only a black toner image is formed.

After the first transfer, toner particles remaining on the surfaces of the photoconductor drums Py, Pm, Pc, and Pk are removed by the photoconductor cleaners CLy, CLm, CLc, and CLk.

The image carrier units Uy, Um, Uc, and Uk and the developing devices Gy, Gm, Gc, and Gk as exemplary developing devices constitute toner-image-forming units Uy+Gy, Um+Gm, Uc+Gc, and Uk+Gk, respectively, as exemplary visible-image-forming units.

A toner dispenser U3*a* as an exemplary supplying device is provided at the top of the image-forming-apparatus body U3. Toner cartridges Ky, Km, Kc and Kk as exemplary developer containers are detachably attached to the toner dispenser U3*a*. As the toners in the developing devices Gy, Gm, Gc, and Gk are consumed in the above image forming process, fresh toners are supplied from the toner cartridges Ky, Km, Kc and Kk to the developing devices Gy, Gm, Gc, and Gk, respectively.

The intermediate transfer belt B provided below the photoconductor drums Py, Pm, Pc, and Pk is stretched around an intermediate driving roller Rd as an exemplary intermediate-transfer-body-driving member, an intermediate tension roller Rt as an exemplary tension applying member that applies tension to the intermediate transfer belt B, an intermediate steering roller Rw as an exemplary first deflection correcting member that corrects any deflection or meandering of the intermediate transfer belt B, plural intermediate idler rollers Rf as exemplary intermediate-transfer-body-following members, and a backup roller T2*a* as an exemplary counter member provided in the second transfer area Q4. The intermediate transfer belt B is supported in such a manner as to rotate in the direction of an arrow Ya when the intermediate driving roller Rd is driven.

The intermediate driving roller Rd, the intermediate tension roller Rt, the intermediate steering roller Rw, the intermediate idler rollers Rf, and the backup roller T2*a* are regarded as belt supporting rollers Rd+Rt+Rw+Rf+T2*a* as exemplary intermediate-transfer-body-supporting members according to the present exemplary embodiment. The intermediate transfer belt B, the belt supporting rollers Rd+Rt+Rw+Rf+T2*a*, and the first transfer rollers T1*y*, T1*m*, T1*c*, and T1*k* constitute a belt module BM as an exemplary intermediate transfer device. The belt module BM according to the present exemplary embodiment is an interchangeable unit that is detachable from the image-forming-apparatus body U3.

The intermediate steering roller Rw according to the present exemplary embodiment is a rotating body including a rotating shaft. The rotating shaft is tiltable toward either side in such a manner as to correct widthwise deflection of the intermediate transfer belt B, whereby any deflection or meandering of the intermediate transfer belt B is corrected. Such a method employed in the intermediate steering roller Rw is known as an active steering method, in which the deflection of a belt is corrected by tilting a rotating shaft in accordance with the result of detection of any deflection of the belt that is obtained by a member such as an optical sensor or a member that comes into contact with an end of the belt. Therefore, detailed description of the intermediate steering roller Rw is omitted.

A second transfer unit Ut as an exemplary transfer-transport device is provided below the backup roller T2*a*. The second transfer unit Ut includes a second transfer roller T2*b* as an exemplary transfer member. The second transfer roller T2*b* is provided across from the backup roller T2*a* in the second transfer area Q4. A contact roller T2*c* as an exemplary voltage-applying contact member is provided in contact with the backup roller T2*a*. The rollers T2*a* to T2*c* constitute a second transfer device T2.

A second transfer voltage of the polarity with which the toner is charged is applied to the contact roller T2*c* at a preset timing from the power circuit E that is controlled by the controller C.

A sheet transport path SH2 is provided below the belt module BM. The recording sheet S that is fed from the sheet transport path SH1 of the sheet feeding device U2 is transported into the sheet transport path SH2. Then, synchronously with the timing of the toner images reaching the second transfer area Q4, a pair of registration rollers Rr as exemplary feeding members feed the recording sheet S into the second transfer area Q4 while sheet guides SG1 and SG2 as exemplary medium guiding members guide the recording sheet S.

The toner images on the intermediate transfer belt B are transferred to the recording sheet S by the second transfer device T2 when passing through the second transfer area Q4. If a color image is to be formed, the toner images having been superposed one on top of another on the intermediate transfer belt B in the first transfer are transferred to the recording sheet S at a time in the second transfer.

The intermediate transfer belt B that has undergone the second transfer is cleaned by a belt cleaner CLB as an exemplary intermediate-transfer-body-cleaning device. Note that the second transfer roller T2*b* is supported in such a manner as to be movable to and away from the intermediate transfer belt B.

The first transfer rollers T1*y*, T1*m*, T1*c*, and T1*k*, the intermediate transfer belt B, the second transfer device T2, the belt cleaner CLB, and other miscellaneous elements constitute a transfer device T1+B+T2+CLB that transfers the toner images on the surfaces of the photoconductor drums Py, Pm, Pc, and Pk to the recording sheet S.

The recording sheet S having the toner images transferred thereto in the second transfer is passed to medium transport belts BH as exemplary transport members. The medium transport belts BH transport the recording sheet S to a fixing device F. The fixing device F includes a heating member Fh as an exemplary thermally fixing member, and a pressing member Fp as an exemplary press-fixing member. An area where the heating member Fh and the pressing member Fp are in contact with each other is defined as a fixing area Q5.

The toner images on the recording sheet S are thermally fixed by the fixing device F when passing through the fixing area Q5. The recording sheet S having the toner images fixed by the fixing device F is then discharged onto an output tray TRh as an exemplary output portion.

The sheet transport paths SH1 and SH2 and other miscellaneous elements constitute a sheet transport path SH. The elements SH, Ra, Rr, SG1, SG2, BH, and other miscellaneous elements constitute a sheet transporting device SU.

Fixing Device

Figure 2:
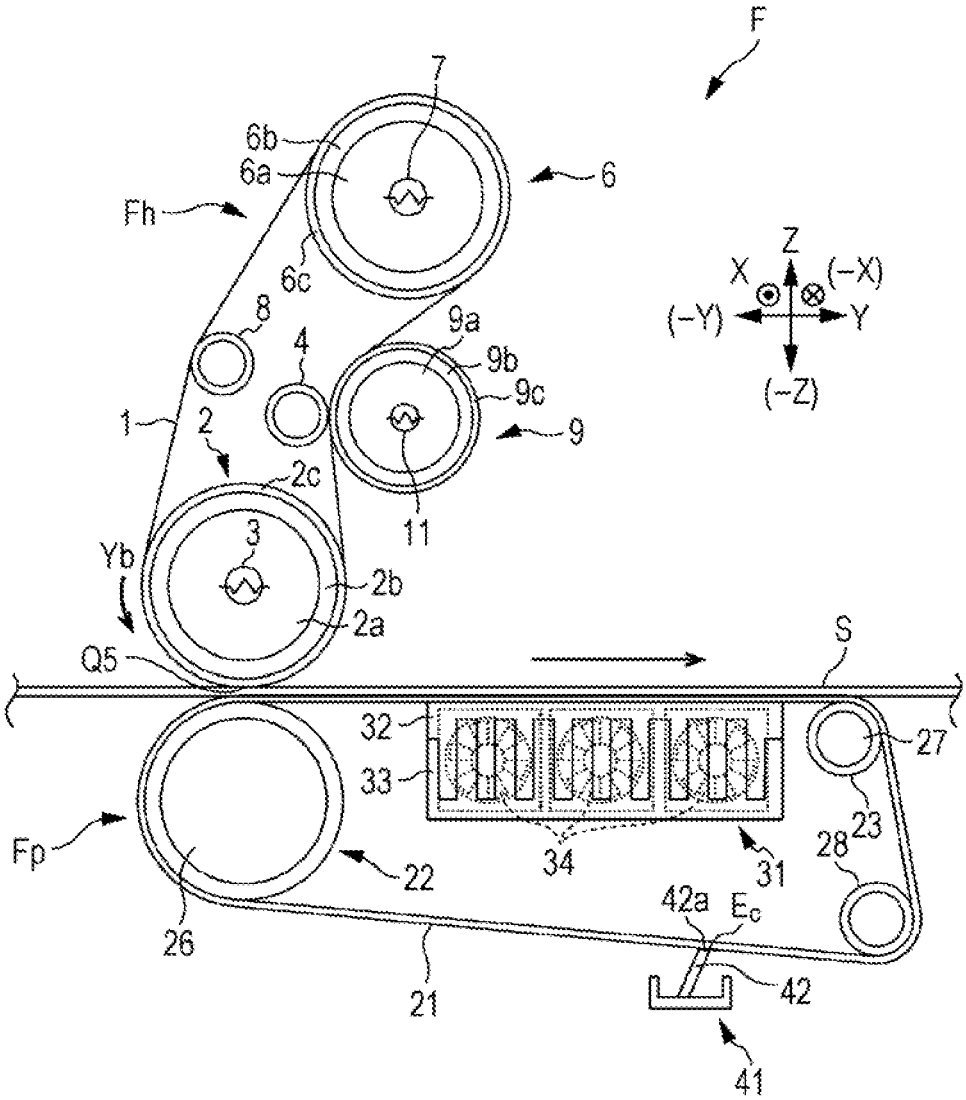
FIG. 2 illustrates relevant parts of a fixing device according to the exemplary embodiment.

FIG. 2 illustrates relevant parts of the fixing device F according to the present exemplary embodiment.

Referring to FIGS. 1 and 2, the heating member Fh of the fixing device F according to the present exemplary embodiment includes a heating belt 1 as an exemplary heating object. The heating belt 1 according to the present exemplary embodiment is an endless-belt-like or substantially endless-belt-like elastic member that is elastically deformable. A first heating roller 2 as an exemplary heating member is provided at a position on the inner circumferential side of the heating belt 1 in such a manner as to face the sheet transport path SH.

The first heating roller 2 according to the present exemplary embodiment has a cylindrical shape that extends in the front-rear direction. The first heating roller 2 includes a base member 2*a*. The base member 2*a* according to the present exemplary embodiment has a cylindrical shape that extends in the front-rear direction. The base member 2*a* supports an elastic layer 2*b* provided thereover. A releasing layer 2*c* is provided over the elastic layer 2*b*. The base member 2*a* according to the present exemplary embodiment may be made of a metal material such as aluminum, stainless steel, or iron. The elastic layer 2*b* according to the present exemplary embodiment may be made of a heat-resistant elastic material such as silicone rubber. The releasing layer 2*c* may be made of a material such as tetrafluoroetylene-perfluoroalkylvinylether copolymer (PFA). A heater 3 as an exemplary heat source is provided inside the first heating roller 2. A driving force is transmitted from a drive source (not illustrated) to the first heating roller 2.

A right supporting roller 4 as an exemplary supporting member is provided above the first heating roller 2. A second heating roller 6 as an exemplary heating-member body is provided on the upper right side of the right supporting roller 4. The second heating roller 6 according to the present exemplary embodiment includes a base member 6*a*, an elastic layer 6*b*, and a releasing layer 6*c* that are equivalent to the base member 2*a*, the elastic layer 2*b*, and the releasing layer 2*c* of the first heating roller 2. A heater 7 as an exemplary heat source is provided inside the second heating roller 6. A left supporting roller 8 as an exemplary supporting member is provided on the lower left side of the second heating roller 6.

In the present exemplary embodiment, the heating belt 1 is stretched around the first heating roller 2, the right supporting roller 4, the second heating roller 6, and the left supporting roller 8. When the first heating roller 2 rotates, the heating belt 1 rotates in the direction of an arrow Yb.

A third heating roller 9 as an exemplary heating-member body is provided at a position on the outer circumferential side of the heating belt 1 and across from the right supporting roller 4. The third heating roller 9 according to the present exemplary embodiment includes a base member 9*a*, an elastic layer 9*b*, and a releasing layer 9*c* that are equivalent to the base member 2*a*, the elastic layer 2*b*, and the releasing layer 2*c* of the first heating roller 2. A heater 11 as an exemplary heat source is provided inside the third heating roller 9.

In the heating member Fh according to the present exemplary embodiment, the temperature of each of the heaters 3, 7, and 11 is set in accordance with a fixing temperature $T_1$ at which the toner images on the recording sheet S passing through the fixing area Q5 are fixable. In the present exemplary embodiment, for example, the fixing temperature $T_1$ is set to 100° C., and the temperature of each of the heaters 3, 7, and 11 is set to 150 to 160° C. so that the fixing temperature $T_1$ of 100° C. is maintained.

Referring to FIGS. 1 and 2, the pressing member Fp as an exemplary fixing member includes a pressing belt 21 as an exemplary endless-belt-like or substantially endless-belt-like rotating body.

The pressing belt 21 according to the present exemplary embodiment has a surface made of thermoplastic synthetic resin. The thermoplastic synthetic resin constituting the surface of the pressing belt 21 starts to soften at a softening temperature $T_2$ that is below the fixing temperature $T_1$, and has a glass-transition temperature $T_g$ that is above the fixing temperature $T_1$.

In the present exemplary embodiment, a portion of the pressing belt 21 that is passing through the fixing area Q5 is heated by the heating member Fh to a temperature $T_3$ that is between the fixing temperature $T_1$ and the softening temperature $T_2$.

Figure 3:
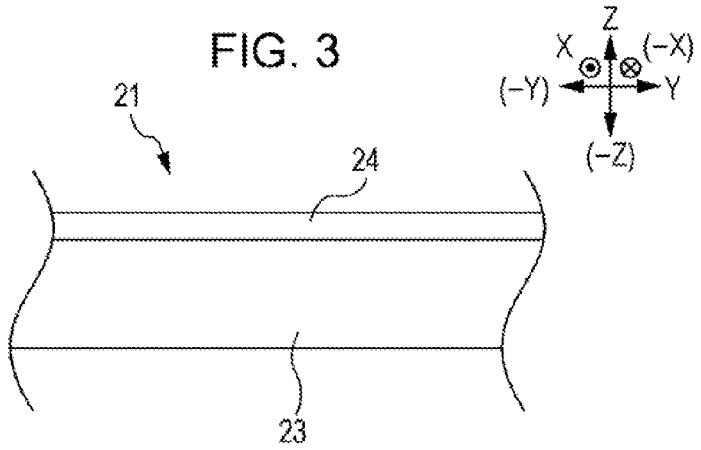
FIG. 3 is an enlarged view of a pressing belt according to the exemplary embodiment.

FIG. 3 is an enlarged view of the pressing belt 21 according to the present exemplary embodiment.

In the present exemplary embodiment, the outer surface of the pressing belt 21 is made of thermoplastic polyimide resin as exemplary thermoplastic synthetic resin. In the present exemplary embodiment, a product called "Upilex (a registered trademark) VT" of Ube Industries, Ltd., which includes a thermosetting-polyimide-resin base member that carries a thermoplastic-polyimide-resin surface layer on each of the outer and inner sides thereof, may be used as the pressing belt 21 after the surface layer on the inner side thereof is removed. That is, as illustrated in FIG. 3, the pressing belt 21 may include a thermosetting-polyimide-resin base member 23 and a thermoplastic-polyimide-resin surface layer 24 provided thereover. Thermoplastic polyimide resin starts to soften at a softening temperature $T_2$ of about 70° C., while the glass-transition temperature $T_g$ thereof is 240° C. Hence, in the present exemplary embodiment, if the fixing temperature $T_1$ in the fixing area Q5 is 100° C., the pressing belt 21 is softened to an extent at which the characteristics of the pressing belt 21 are not altered or the pressing belt 21 is not melted.

A pressing roller 26 as an exemplary pressing-member body and as an exemplary supporting member is provided at a position on the inner circumferential side of the pressing belt 21 and across the pressing belt 21 and the heating belt 1 from the first heating roller 2. The pressing roller 26 according to the present exemplary embodiment has, for example, a cylindrical or columnar shape extending in the front-rear direction, as with the first heating roller 2. The pressing roller 26 according to the present exemplary embodiment is pressed against the first heating roller 2, with the pressing belt 21 and the heating belt 1 interposed therebetween, by springs (not illustrated) as exemplary urging members.

Hence, in the present exemplary embodiment, when the first heating roller 2 rotates, the heating belt 1 rotates and thus the pressing belt 21 rotates by following the rotation of the heating belt 1. An upper press-supporting roller 27 as an exemplary supporting member is provided on the downstream side with respect to the pressing roller 26 in the direction of rotation of the pressing belt 21. Furthermore, a lower press-supporting roller 28 as an exemplary supporting member is provided on the downstream side with respect to the upper press-supporting roller 27 in the direction of rotation of the pressing belt 21.

In the present exemplary embodiment, the pressing belt 21 is stretched around the pressing roller 26 and the press-supporting rollers 27 and 28. A cooling device 31 as an exemplary cooling member is provided between the pressing roller 26 and the upper press-supporting roller 27 in the direction of rotation of the pressing belt 21. The cooling device 31 according to the present exemplary embodiment includes a contact portion 32 that is in contact with the inner circumferential surface of the pressing belt 21. The contact portion 32 is provided with a heat sink 33 as an exemplary heat radiating member. Furthermore, cooling fans 34 as exemplary blowing members are provided at the rear end of the heat sink 33.

In the present exemplary embodiment, when a fixing operation is performed, cooling air is blown from the cooling fans 34 toward the heat sink 33. In the cooling device 31 according to the present exemplary embodiment, the sizes and shapes of the contact portion 32 and the heat sink 33 and the wind force of the cooling fans 34 are set such that the temperature of the pressing belt 21 is lowered to a temperature below the softening temperature $T_2$ while the pressing belt 21 that is rotating passes over the cooling device 31.

A cleaner 41 as an exemplary cleaning device is provided on the outer circumferential side of the pressing belt 21 in a cleaning area $E_c$ that is on the downstream side with respect to the lower press-supporting roller 28 in the direction of rotation of the pressing belt 21. In the cleaning area $E_c$ according to the present exemplary embodiment, the pressing belt 21 has already been hardened because the pressing belt 21 has already been cooled to a temperature below the softening temperature $T_2$ by the cooling device 31. The cleaner 41 includes a cleaning blade 42 as an exemplary cleaning member. The cleaning blade 42 according to the present exemplary embodiment has a plate-like shape extending in the width direction of the pressing belt 21, i.e., in the front-rear direction. The cleaning blade 42 according to the present exemplary embodiment is in contact with the surface of the pressing belt 21 at a tip 42*a* thereof that is oriented in a counter direction, i.e., toward the upstream side in the direction of rotation of the pressing belt 21.

Operation of Fixing Device

Figure 4:
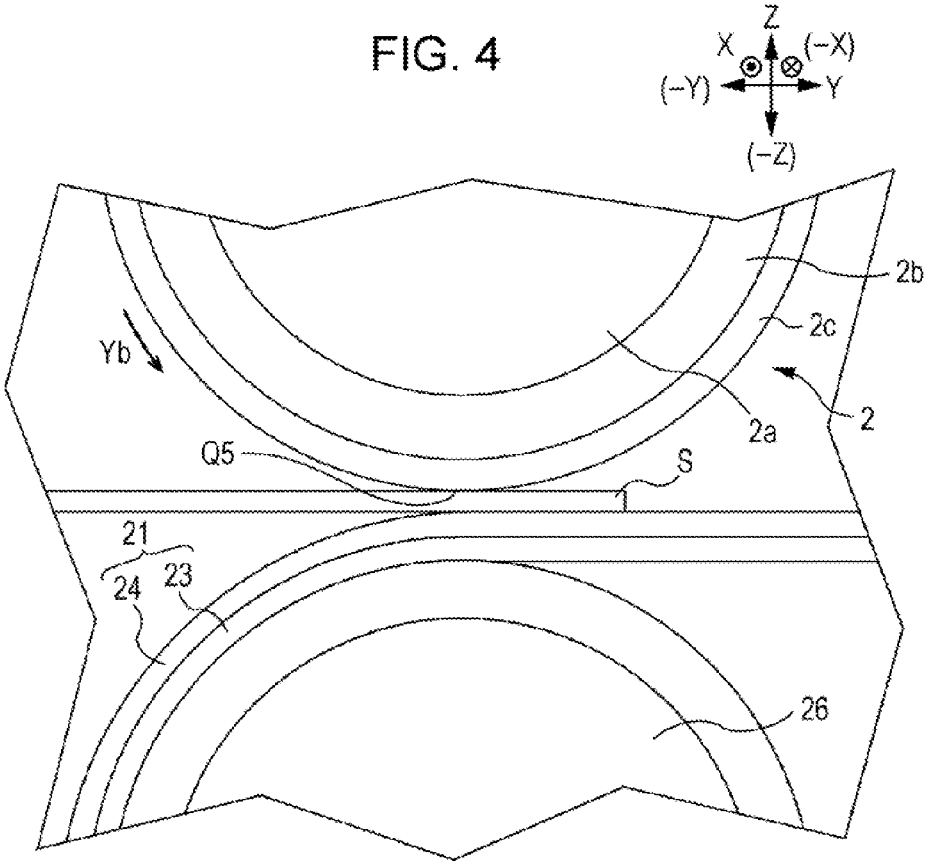
FIG. 4 is an enlarged view of a fixing area according to the exemplary embodiment.

FIG. 4 is an enlarged view of the fixing area Q5 according to the present exemplary embodiment.

Referring to FIGS. 2 and 4, in the image forming apparatus U according to the present exemplary embodiment that is configured as described above, the recording sheet S is transported to the fixing device F with the toner images that have been transferred thereto in the second transfer area Q4 being unfixed. In the fixing device F, the recording sheet S is pressed and heated while being nipped by the first heating roller 2 and the pressing roller 26 with the heating belt 1 and the pressing belt 21 interposed therebetween. Thus, when the recording sheet S passes through the fixing device F, the unfixed toner images on the recording sheet S are fixed with the heat and the pressure.

At least the surface of the pressing belt 21 is made of thermoplastic polyimide resin. Therefore, when the pressing belt 21 carrying the recording sheet S passes through the fixing area Q5, the pressing belt 21 carrying the recording sheet S is heated to an extent at which the characteristics of the pressing belt 21 are not altered or the pressing belt 21 is not melted, whereby the pressing belt 21 is softened. Hence, when the recording sheet S passes through the fixing area Q5, the pressing belt 21 that has been softened comes into close contact with the recording sheet S.

According to the present exemplary embodiment, the recording sheet S is in close contact with the softened pressing belt 21 while passing through the fixing area Q5. Therefore, the force of friction between the pressing belt 21 and the recording sheet S is greater in the present exemplary embodiment than in a case where the pressing belt has a smooth surface. Hence, when the recording sheet S that is heated is about to shrink with the heat, the heat shrinkage of the recording sheet S is suppressed with the force of friction between the pressing belt 21 and the recording sheet S. Thus, the probability that the recording sheet S may shrink and be deformed to deteriorate image quality is reduced.

The recording sheet S having the toner images thus fixed by the fixing device F is transported to the cooling device 31. In the cooling device 31, the contact portion 32 is in contact with the inner circumferential surface of the pressing belt 21, whereby the pressing belt 21 is cooled. Thus, a portion of the pressing belt 21 that has passed over the cooling device 31 is cooled to a temperature below the softening temperature $T_2$ and is therefore hardened.

The pressing belt 21 that has been softened with heat comes into close contact with the recording sheet S. Therefore, the recording sheet S may be difficult to be released from the pressing belt 21. In such a case, the recording sheet S passing over the upper press-supporting roller 27 may wrap around the pressing belt 21 instead of being released from the pressing belt 21, resulting in defective transport, i.e., a jam.

According to the present exemplary embodiment, however, when the recording sheet S passes over the upper press-supporting roller 27, the pressing belt 21 carrying the recording sheet S has already been cooled and hardened. Therefore, the adhesiveness between the recording sheet S and the pressing belt 21 has already been reduced. Hence, the recording sheet S is more easily released from the pressing belt 21 in the present exemplary embodiment than in a case where the recording sheet S may remain in close contact with the softened pressing belt 21. Accordingly, the probability that a jam may occur because the recording sheet S is not released from the pressing belt 21 is reduced.

The portion of the pressing belt 21 from which the recording sheet S has been released is transported to the cleaning area $E_c$. The pressing belt 21 may attract some unwanted substances such as unnecessary toner particles and paper lint. Such substances that have attracted to the pressing belt 21 are removed by the cleaner 41 provided in the cleaning area $E_c$.

In this step, if the pressing belt 21 includes a soft surface layer so as to provide adhesiveness to the recording sheet S or if the pressing belt 21 is in a thermally softened state, the force of friction generated between the tip 42*a* of the cleaning blade 42 and the pressing belt 21 is large. If the force of friction generated between the tip 42*a* of the cleaning blade 42 and the pressing belt 21 is large, the cleaning blade 42 may be turned up, causing defective cleaning. Moreover, the pressing belt 21 that is in a softened state is more likely to be scraped or abraded by the tip 42*a* of the cleaning blade 42 that comes into contact therewith than the pressing belt 21 that is in a hardened state.

In the present exemplary embodiment, however, when the pressing belt 21 passes through the cleaning area $E_c$, the tip 42*a* of the cleaning blade 42 comes into contact with a cooled, hardened portion of the pressing belt 21. Therefore, the force of friction generated between the pressing belt 21 and the tip 42*a* of the cleaning blade 42 is smaller in the present exemplary embodiment than in a case where the surface layer of the pressing belt 21 is in a softened state. Accordingly, in the present exemplary embodiment, the cleaning blade 42 is less likely to be turned up, and the occurrence of defective cleaning is suppressed. Furthermore, in the present exemplary embodiment, the occurrence of scraping or wear of the pressing belt 21 due to the contact with the tip 42*a* is suppressed. Consequently, the occurrence of damage to the pressing belt 21 is suppressed, and the life of the pressing member Fp is prolonged.

EXAMPLES

An experiment is performed for demonstrating the effects produced by the above exemplary embodiment of the present invention.

In the following experiment, the rate of shrinkage of the recording sheet S is measured as follows. In the image forming apparatus U according to the above exemplary embodiment, recording sheets S are passed through the fixing area Q5 at different fixing temperatures $T_1$ that are set by changing the temperature of the heaters 3, 7, and 11 within a range of 90 to 190° C. Each of the recording sheets S that are passed through the fixing area Q5 is either a polystyrene (PS) film having a thickness of 50 μm or a polyethylene-terephthalate (PET) film having a thickness of 40 μm. The widthwise length of the PS film or the PET film is measured before and after the film is passed through the fixing area Q5, whereby the rate of shrinkage of the PS film or the PET film that has been passed through the fixing area Q5 is obtained. That is, the rate of shrinkage is calculated as follows: (widthwise length before passing−widthwise length after passing)/widthwise length before passing×100(%).

Working Example 1-1

In Working Example 1-1, a product called "Upilex (a registered trademark) VT" of Ube Industries, Ltd. is used as the pressing belt 21 after the surface layer on the inner side thereof is removed, and a PS film having a thickness of 50 μm is used as the recording sheet S.

Working Example 1-2

In Working Example 1-2, the same pressing belt 21 as that used in Working Example 1-1 is used, and a PET film having a thickness of 40 μm is used as the recording sheet S.

Comparative Example 1-1

In Comparative Example 1-1, a product called "SHIN-ETSU SIFEL (a registered trademark)" of Shin-Etsu Chemical Co., Ltd., which is made of thermosetting liquid fluoroelastomer, is provided with a uniform thickness over a belt and is hardened, and a resulting thermosetting pressing belt is used. Furthermore, a PS film having a thickness of 50 μm is used as the recording sheet S.

Comparative Example 1-2

In Comparative Example 1-2, the same thermosetting pressing belt as that used in Comparative Example 1-1 is used, and a PET film having a thickness of 40 μm is used as the recording sheet S.

Figure 5A:
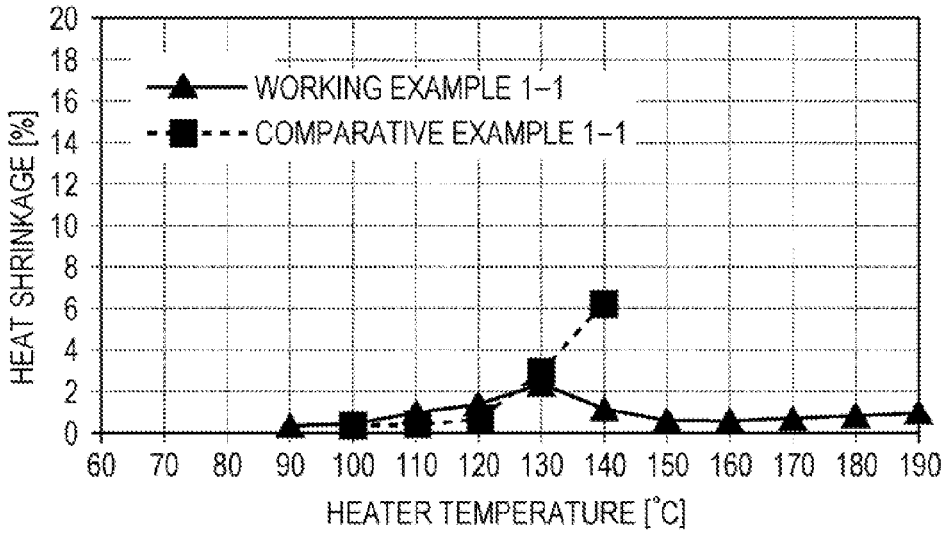
FIG. 5A is a graph illustrating measurements obtained in Working Example 1-1 and in Comparative Example 1-1, with the vertical axis representing the rate of shrinkage of a recording sheet and the horizontal axis representing the temperature of each of heaters.
Figure 5B:
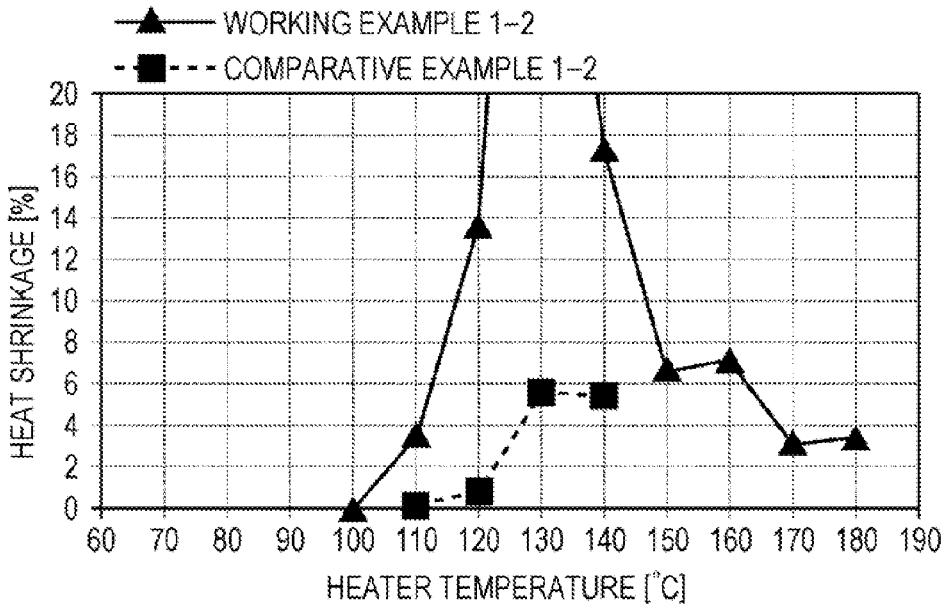
FIG. 5B is a graph illustrating measurements obtained in Working Example 1-2 and Comparative Example 1-2, with the vertical axis representing the rate of shrinkage of the medium and the horizontal axis representing the temperature of each of the heaters.

FIGS. 5A and 5B are graphs illustrating the measurements obtained in the above examples, with the vertical axis representing the rate of shrinkage of the recording sheet S and the horizontal axis representing the temperature of the heaters. FIG. 5A illustrates the measurements obtained in Working Example 1-1 and Comparative Example 1-1. FIG. 5B illustrates the measurements obtained in Working Example 1-2 and Comparative Example 1-2.

In general, PS films and PET films tend to shrink more at higher temperature. As graphed in FIGS. 5A and 5B, the rate of shrinkage of the PS film or the PET film in each of Comparative Examples 1-1 and 1-2 tends to increase with the rise of the temperature of the heaters 3, 7, and 11.

In each of Working Examples 1-1 and 1-2, as graphed in FIGS. 5A and 5B, the rate of shrinkage of the PS film or the PET film increases with the rise of the temperature of the heaters 3, 7, and 11 before the temperature of the pressing belt 21 reaches the softening temperature $T_2$ (70° C.), that is, before the temperature of the heaters 3, 7, and 11 reaches 130° C.; whereas the rate of shrinkage of the PS film or the PET film decreases after the temperature of the pressing belt 21 exceeds the softening temperature $T_2$. This is presumably because the adhesiveness between the PS film or the PET film and the pressing belt 21 increases with the softening of the pressing belt 21. In the above exemplary embodiment, the temperature of each of the heaters 3, 7, and 11 is set to 150 to 160° C., which makes the fixing temperature $T_1$ in the fixing area Q5 100° C. Hence, the heat shrinkage of the recording sheet S is more suppressed in the above exemplary embodiment in which the pressing belt 21 is softened than in the case of a fixing belt having a thermosetting surface layer.

Modifications

The following are exemplary modifications (H01) to (H10) that may be made to the exemplary embodiment of the present invention.

(H01) While the above exemplary embodiment concerns the image forming apparatus U, the application of the present invention is not limited thereto. The present invention is applicable to apparatuses such as a printer, a facsimile, and a multifunction machine that has plural functions of the foregoing machines. Moreover, the present invention is applicable not only to a multicolor image forming apparatus but also to a monochrome image forming apparatus.

(H02) While the above exemplary embodiment concerns a case where the pressing belt 21 that softens at a temperature below the fixing temperature $T_1$ is made of a thermoplastic polyimide resin as an exemplary thermoplastic material, the present invention is not limited to such a case. The pressing belt 21 may be made of any material, as long as the material softens at a temperature below the fixing temperature $T_1$ and is hardened in the cleaning area $E_c$. For example, the pressing belt 21 may be made of a thermoplastic material that satisfies the above temperature condition and that includes any one of the following: polycarbonate (PC), polyether sulfone (PES), polysulfone-based resin (PSU), polyarylate (PAR), polyether imide (PEI), and the like.

(H03) While the above exemplary embodiment concerns a case where the pressing member Fp as an exemplary pressing member includes the pressing belt 21 as an exemplary endless-belt-like or substantially endless-belt-like rotating body and the roller-type supporting members 26, 27, and 28, the present invention is not limited to such a case. For example, the pressing member Fp may be substituted for by a roller-type pressing roller or another pressing member having any shape determined in accordance with the design and specifications.

(H04) While the above exemplary embodiment concerns a case where the pressing belt 21 is stretched around the three rollers 26, 27, and 28 as exemplary supporting members, the present invention is not limited to such a case. For example, the pressing belt 21 may be stretched around two or four or more rollers.

(H05) while the above exemplary embodiment concerns a case where the heating member Fh as an exemplary heating member includes the heating belt 1 in the form of an endless-belt-like or substantially endless-belt-like rotating body, the present invention is not limited to such a case. For example, the heating member Fh may be substituted for by a roller-type heating member or another heating member having any shape determined in accordance with the design and specifications. Moreover, for example, the heating belt 1 may be a rubber belt provided with a thermoplastic film pasted on the surface thereof, so that the heating member has a multilayer structure in which at least the surface thereof is made of a thermoplastic material.

(H06) While the above exemplary embodiment concerns a case where the cooling device 31 as an exemplary cooling member includes the heat sink 33 and the cooling fans 34, the present invention is not limited to such a case. For example, the heat sink 33 may be substituted for by a pair of cooling rollers. If the pressing belt 21 is cooled and is hardened by natural heat radiation before reaching the cleaning area $E_c$, one of the heat sink 33 and the cooling fans 34 or the cooling member as a whole may be omitted.

(H07) While the above exemplary embodiment concerns a case where the cleaning blade 42 is employed as an exemplary cleaning member that removes unwanted substances attracted to the surface of the pressing belt 21, the present invention is not limited to such a case. For example, a cleaning member having any shape, such as a known cleaning brush or a cleaning roller, may be employed in accordance with the design and specifications.

(H08) While the above exemplary embodiment concerns a case where the pressing belt 21 rotates by following the rotation of the heating belt 1, the present invention is not limited to such a case. For example, the heating belt 1 may rotate by following the rotation of the pressing belt 21, or the two bels 1 and 21 may be rotated independently of each other by providing respective driving members.

(H09) While the above exemplary embodiment concerns a case where the pressing member Fp is employed as an exemplary fixing member that includes the pressing belt 21, the present invention is not limited to such a case. For example, the heating member Fh may be configured as an exemplary fixing member that includes the pressing belt 21. Moreover, the present invention is not limited to a case where only one of the pressing member Fp and the heating member Fh includes the pressing belt 21. The pressing member Fp and the heating member Fh may include respective thermoplastic belts.

(H10) While the above exemplary embodiment concerns a case where the recording sheet S as an exemplary medium tends to shrink with heat, the present invention is not limited to such a case. For example, if a medium that tends to expand with heat is used, the thermal expansion of the medium is suppressed because the surface layer 24 that is in a softened state comes into close contact with the medium.

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The embodiment was chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A fixing device comprising:

a rotatable fixing member provided in a fixing area where an unfixed image on surface of a medium is fixed, the fixing member including at least a thermoplastic surface layer that softens at a temperature below a fixing temperature at which the image is fixed; and a cleaning member provided on a downstream side with respect to the fixing area in a direction of rotation of the fixing member and that cleans the fixing member while coming into contact with a hardened portion of the fixing member in a cleaning area, the cleaning area being at a temperature below the temperature at which the thermoplastic surface layer of the fixing member softens.

2. The fixing device according to claim 1, further comprising a cooling member provided on the downstream side with respect to the fixing area and on an upstream side with respect to the cleaning area in the direction of rotation of the fixing member, the cooling member cooling the fixing member.

3. The fixing device according to claim 1, wherein the fixing member includes a substantially endless-belt-like rotating body; and a supporting member that supports the substantially endless-belt-like rotating body.

4. An image forming apparatus comprising:

an image carrier on a surface of which an unfixed image is formed;

a transfer device that transfers the unfixed image from the image carrier to a medium; and the fixing device according to claim 1 that fixes the unfixed image on the medium.

* * * * *